US012391342B2

(12) United States Patent
Trewern

(10) Patent No.: US 12,391,342 B2
(45) Date of Patent: Aug. 19, 2025

(54) METHOD AND SYSTEM FOR OPERATING A HYDROFOIL BOARD

(71) Applicant: Fliteboard Pty Ltd, Byron Bay (AU)

(72) Inventor: David Trewern, Sydney (AU)

(73) Assignee: FLITEBOARD PTY LTD, Byron Bay (AU)

( * ) Notice: Subject to any disclaimer, the term of this patent is extended or adjusted under 35 U.S.C. 154(b) by 0 days.

(21) Appl. No.: 18/748,697

(22) Filed: Jun. 20, 2024

(65) Prior Publication Data

US 2024/0343351 A1 Oct. 17, 2024

Related U.S. Application Data

(63) Continuation of application No. 18/452,927, filed on Aug. 21, 2023, now Pat. No. 12,043,351, which is a (Continued)

(30) Foreign Application Priority Data

Mar. 26, 2018 (AU) ..... 2018901001

(51) Int. Cl.
*B63B 32/10* (2020.01)
*B63B 32/64* (2020.01)
(Continued)

(52) U.S. Cl.
CPC ..... *B63B 32/10* (2020.02); *B63B 32/64* (2020.02); *B63H 21/21* (2013.01); *B63H 21/17* (2013.01); *B63H 2021/216* (2013.01)

(58) Field of Classification Search
CPC ..... B63B 32/10; B63B 32/64; B63H 21/21
See application file for complete search history.

(56) References Cited

U.S. PATENT DOCUMENTS 5,309,859 A 5/1994 Miller
9,359,044 B2 6/2016 Langelaan
(Continued)

FOREIGN PATENT DOCUMENTS

CN 204056245 12/2014
CN 106864717 6/2017
(Continued)

OTHER PUBLICATIONS

"Ergonomic, simple, waterproof remote control", in FOIL.zone, Jan. 1, 2018, XP093014084; https://foil.zone/t/ergonomic-simple-waterproof-remote-control/1015; p pgs.
(Continued)

*Primary Examiner* — S. Joseph Morano
*Assistant Examiner* — Jovon E Hayes
(74) *Attorney, Agent, or Firm* — Andrus Intellectual Property Law, LLP

(57) ABSTRACT

Disclosed is a method for controlling a hydrofoil board powered by a motor driven propeller. The motor is controlled by a hand controller configured with user selectable operating pre-sets including a first operating pre-set, wherein the board is accelerated to a first speed which is less than that required for the board to hydrofoil, and a second operating pre-set, wherein the board is accelerated to a second speed sufficient for the board to hydrofoil. Alternatively, the operating pre-sets may limit the motor power. A system for operating a hydrofoil board is also disclosed, which includes a propulsion control unit comprising a propulsion source, and a hand controller configured to receive a first user input and a second user input and to transmit the user inputs to the propulsion control unit.

20 Claims, 8 Drawing Sheets

Related U.S. Application Data continuation of application No. 17/883,769, filed on Aug. 9, 2022, now Pat. No. 11,760,444, which is a continuation of application No. 17/042,088, filed as application No. PCT/AU2019/050262 on Mar. 25, 2019, now Pat. No. 11,453,465.

(51) Int. Cl.
*B63H 21/21* (2006.01)
*B63H 21/17* (2006.01)

(56) References Cited

U.S. PATENT DOCUMENTS

| | | | | |
|---|---|---|---|---|
| 9,586,659 | B2 | 3/2017 | Langelaan | |
| 9,607,506 | B1 * | 3/2017 | Manning | G06F 1/163 |
| 10,235,870 | B2 * | 3/2019 | Leason | G05D 1/0016 |
| 10,358,194 | B1 * | 7/2019 | Wengreen | G05D 1/0206 |
| 10,994,815 | B2 | 5/2021 | Wengreen | |
| 2012/0000409 | A1 * | 1/2012 | Railey | B63B 32/40 29/428 |
| 2013/0059489 | A1 * | 3/2013 | Vlock | B60L 1/003 440/6 |
| 2013/0323989 | A1 | 12/2013 | Derrah | |
| 2015/0104985 | A1 * | 4/2015 | Langelaan | B63H 1/16 441/74 |
| 2017/0283015 | A1 | 10/2017 | Langelaan | |
| 2018/0072383 | A1 * | 3/2018 | Montague | B63B 32/64 |
| 2019/0106190 | A1 * | 4/2019 | Schibli | B63H 20/007 |
| 2021/0107601 | A1 * | 4/2021 | Trewern | B63B 32/64 |
| 2022/0063786 | A1 * | 3/2022 | Montague | B63H 21/17 |

FOREIGN PATENT DOCUMENTS

| | | |
|---|---|---|
| DE | 202017103703 | 7/2017 |
| JP | 2002154479 | 5/2002 |
| TW | 200716441 | 5/2007 |
| TW | 200831353 | 8/2008 |
| WO | 2015033032 | 3/2015 |
| WO | 2018191157 | 10/2018 |

OTHER PUBLICATIONS

Applicant: Fliteboard Pty Ltd; "A Method and System for Operating a Hydrofoil Board", European Application No. 19777269.2; Extended European Search Report dated Dec. 7, 2021; 26 pgs.

Applicant: Fliteboard Pty Ltd; "A Method and System for Operating a Hydrofoil Board", Chinese Application No. 201980034865.0; First Chinese Office Action dated Mar. 2, 2023; 57 pgs.

Applicant: Fliteboard Pty Ltd; "A Method and System for Operating a Hydrofoil Board", European Application No. 19777269.2; European Office Action dated Jan. 23, 2023; 12 pgs.

Singapore Application No. 11202009485R filed Mar. 25, 2019; Singapore Examination Report dated Nov. 15, 2021; 6 pgs.

* cited by examiner

METHOD AND SYSTEM FOR OPERATING A HYDROFOIL BOARD

CROSS-REFERENCE TO RELATED APPLICATIONS

The present application is a continuation of U.S. patent application Ser. No. 18/452,927, filed Aug. 21, 2023, which '927 application is the continuation of Ser. No. 17/883,769, filed Aug. 9, 2022, issued as U.S. Pat. No. 11,760,444, which '769 application is a continuation of Ser. No. 17/042,088, filed Sep. 25, 2020, issued as U.S. Pat. No. 11,453,465, which '088 application is the U.S. national stage entry of PCT/AU2019/050262, filed Mar. 25, 2019, which claims priority from Australian Provisional Patent Application Number 2018901001, filed Mar. 26, 2018. All of which applications are incorporated herein by reference in entirety.

TECHNICAL FIELD

The present invention generally relates to a method and system for operating a hydrofoil board.

BACKGROUND

Hydrofoil boards are a style of watercraft taking the general appearance of a surfboard or stand-up paddle board, with a hydrofoil motor. By this arrangement, the hydrofoil board is capable of hydrofoiling such that the board is raised above the surface of the water. Hydrofoil boards may reduce the drag and provide for fast and exciting travel over a water surface. However, some users may find the act of riding and controlling a hydrofoil board challenging.

It may thus be desirable to provide a method and system for operating a hydrofoil board that simplifies operation. Such a method and system may also be useful in other powered board applications, such as electric skateboards.

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavour to which this specification relates.

SUMMARY

According to one aspect of the invention, there is provided a method for controlling a hydrofoil board powered by a motor driven propeller, wherein the motor is controlled by a hand controller configured with user selectable operating pre-sets including: a first operating pre-set, wherein the board is accelerated to a first speed which is less than that required for the board to hydrofoil; and, a second operating pre-set, wherein the board is accelerated to a second speed sufficient for the board to hydrofoil.

According to another aspect of the invention, there is provided a method of controlling a hydrofoil board powered by a motor driven propeller, wherein the motor is controlled by a hand controller configured with a throttle for regulating a speed of the board, the hand controller also configured with user selectable operating pre-sets including: a first operating pre-set, wherein the board is accelerated to a maximum first speed which is less than that required for the board to hydrofoil; and a second operating pre-set, wherein the board is accelerated to a second speed which is sufficient for the board to hydrofoil. Preferably, the speed of the board is measured by GPS.

According to yet another aspect of the invention, there is provided a method of controlling a hydrofoil board powered by a motor driven propeller, wherein the motor is controlled by a hand controller configured with a throttle for regulating motor power, the hand controller also configured with user selectable operating pre-sets including: a first operating pre-set, wherein the motor power is limited to a first value which is less than that required for the board to hydrofoil; and a second operating pre-set, wherein the motor power is limited to a second value which is sufficient for the board to hydrofoil.

In one example form, the throttle can be operated at the same time as a user switches between the operating pre-sets. In another form, ten or more operating pre-sets are provided.

According to another aspect of the invention, there is provided a system for operating a hydrofoil board, the system including: a propulsion control unit including a propulsion source; and a hand controller configured to receive a first user input and a second user input and to transmit the user inputs to the propulsion control unit, the first user input being a variable throttle value and the second user input selecting one of a plurality of operating pre-sets of operation of the propulsion control unit; wherein, in response to the user inputs, the propulsion control unit is configured to drive the propulsion source according to the selected throttle value only up to a maximum level that is determined by the selected operating pre-set.

In one example form, the plurality of operating pre-sets includes: a first operating pre-set, wherein the propulsion source increases the speed of the board to a first speed that is less than a hydrofoiling speed; and a second operating pre-set, wherein the propulsion source increases the speed of the board to a second speed suitable for the board to hydrofoil and rise from the water surface.

In another form, the plurality of operating pre-sets includes: a first operating pre-set, wherein the power of the propulsion source is limited to a first maximum value that is less than what is required for the board to hydrofoil; and a second operating pre-set, wherein the power of the propulsion source can increase to a second maximum value suitable for the board to hydrofoil and rise from the water surface.

In other particular, but non-limiting, example forms: the system further includes a receiver configured to receive and transmit signals between the hand controller and the propulsion control unit; the receiver is located at a forward portion of the board; and the hand controller includes an output configured to display one or more performance and/or diagnostic data chosen from the group consisting of: board speed; remaining travel distance; remaining travel time; battery temperature; battery charge; and rate of power consumption. Preferably, the propulsion source is deactivated based on proximity and/or relative motion of the hand controller and the board.

In another example form, the operating pre-set can be automatically changed based on a geographic location of the board. This automatically selected operating pre-set may be the first or second pre-set described previously, or some other operating pre-set. In one form, this automatically selected operating pre-set has a lower speed/power limit than the second operating pre-set. In yet another form, the hand controller further includes an output in the form of a buzzer and/or vibrator.

According to another aspect of the invention, there is provided a hand controller for use with the system as defined herein.

BRIEF DESCRIPTION OF FIGURES

Example embodiments should become apparent from the following description, which is given by way of example only, of at least one preferred but non-limiting embodiment, described in connection with the accompanying figures, wherein.

DETAILED DESCRIPTION

Figure 1:
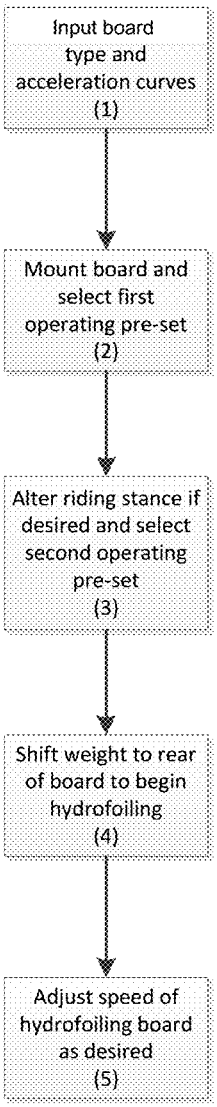
FIG. 1 illustrates a flow chart of an embodiment of a method for operating a hydrofoil board.

The following modes, given by way of example only, are described in order to provide a more precise understanding of the subject matter of a preferred embodiment or embodiments.

In the figures, incorporated to illustrate features of an example embodiment, like reference numerals are used to identify like parts throughout the figures.

Described herein is an embodiment of a method for operating a hydrofoil board. The board may be driven by a propulsion source, which may be a motor driven propeller. The motor driven propeller may be controlled by a user operated controller, such as a hand controller, which a user may hold in their grip while riding the board.

The operation of the board according to the method may include certain operating pre-sets. In an embodiment, the hand controller may facilitate the selection of these operating pre-sets. For example, the method may include a first operating pre-set where the board is brought up to a speed below that for hydrofoiling and a second operating pre-set where the board is brought up to a speed sufficient for the board to begin hydrofoiling. Once the second operating pre-set has been selected, thus accelerating the board to a speed sufficient to begin hydrofoiling, the speed of the board may be controlled, preferably via the hand controller, according to user preference.

The method may include a first operating pre-set, where the board is brought up to a speed less than that required for hydrofoiling, which may be termed a first speed. The first operating pre-set may be suitable for allowing a user to balance themselves on the board prior to the board hydrofoiling. For example, the user, who may be lying on the stationary board in a prone position, may select the first operating pre-set via the hand controller, such that the propulsion source is supplied sufficient power to bring the board up to a first speed. With the board in motion at the first speed, the user may adjust their position, if desired, to their preferred riding stance in preparation for hydrofoiling, for example kneeling or standing.

The method may include a second operating pre-set, where the board is brought up to a speed sufficient to begin hydrofoiling, which may be termed the second speed. The second operating pre-set may be selected after a user has balanced themselves in their chosen riding stance, for example a standing position, with the board moving at a first speed. Once the board has reached the second speed, the user may shift their weight backwardly, thereby altering the angle of attack of the submerged hydrofoil attached to the board. By this action, the board may begin hydrofoiling, and as such, may rise above the water surface.

After the second operating pre-set has been selected, the speed of the board may be adjusted according to user preference. For example, after the second operating pre-set has been selected and the user is riding the now hydrofoiling board, the user may wish to increase speed in order to increase their sense of thrill. Similarly, the rider may wish to decrease their speed. In an embodiment, the hand controller may be used to increase and decrease the speed of the board after it has begun to hydrofoil.

While the operating pre-sets and other features of the invention described herein are not essential to ride a powered hydrofoil board, they are advantageous to the process because they provide real benefits in a number of ways, including the tuning of systems, riding to the limits of the system without causing issues, and maximising the range and performance of the board.

The method of the present invention may be achieved using a controller to select the operating pre-set of operation of the board. In an embodiment, the controller may be a hand controller, having a user interface which may include an input device and an output device. The user interface may include a trigger style actuator located on a pistol style handle of the hand controller. The user interface may also include one or more buttons actuatable by the thumb of a user having grip of the handle. The buttons may include a button with a "+" indicia and a button with a "−" indicia.

In an embodiment, the hand controller may be used in conjunction with the board to achieve the method in the following manner. Firstly, with the board stationary and the user balanced thereon, the hand controller trigger may be fully engaged to select a first operating pre-set, wherein the board is accelerated up to the first speed. Alternatively, the board may be more gradually brought up to the first speed through a gradual application of the trigger by the user until it is fully engaged.

Once the user is comfortable with the board moving at the first speed, the user may orientate themselves on the board in their preferred riding stance for hydrofoiling, for example, in a standing position, while maintaining engagement of the trigger. By having the trigger completely depressed at this time with the speed limited while they are adjusting position, this removes any risk of bumping the throttle, which could vary the power or speed and cause a potential crash.

With the rider orientated in their preferred hydrofoiling position, the user may place the board in the second operating pre-set by actuating a button on the hand controller, thereby causing the board to accelerate up to the second speed. With the board in the second speed, the user may shift their weight backwardly in relation to the board thereby causing the board to begin hydrofoiling and lift above the surface of the water.

With the user now riding the hydrofoiling board, they may alter the speed of the board according to their riding preference, wherein the speed of the board is adjustable. For example, the hand controller may have a button for increasing speed and a button for decreasing speed, which may correspond to buttons with "+" and "−" indicia respectively, by way of example. Alternatively, the speed may be reduced by partially releasing the trigger.

By using the above method, the act of riding a hydrofoil may be broken into distinct steps, thus making the act of riding a hydrofoil board simpler and more accessible to a variety of users.

In an embodiment, once the trigger of the hand controller has been engaged, thus placing the board in the first operating pre-set, it may then act as a "deadman's switch" such that the trigger must remain engaged in order for the board to remain under power. By this manner, the user, having actuated the trigger to place the board in the first operating pre-set, may maintain their grip on the trigger while actuating the button to place the board in the second operating pre-set. Then, with the board in the second operating pre-set and travelling at the second speed, the user may continue to maintain their grip on the trigger while adjusting the speed of the board via the requisite buttons on the hand controller.

If the trigger is released at any time, power to the propulsion source will be lost, such that the speed of the board will reduce, and/or come to a stop. In some embodiments the trigger may act as a switch, while in other embodiments the reduction in power may be gradual corresponding to a degree to which the trigger is released.

In an embodiment, the first and second speeds may be selected according to the weight of a user. In a further embodiment, the first and second speed may be selected according to the type of board used, for example, the design of the hydrofoil wings or other design parameters that may affect the performance of the board, for example, the hydrofoiling performance of the board. By this manner, the first speed may be selected to be less than a hydrofoiling speed for the specific weight of the user and the specific board design, and the second speed may be selected to be suitable for hydrofoiling for the specific weight of the user and the specific board design.

The user may select their weight and the type of board used via the hand controller, such that the first and second speeds are determined via a processing system. By this manner, the first speed will be selected to be less than a hydrofoiling speed, and the second speed may be selected to be sufficient for hydrofoiling for a user's specific weight, and for a specific board design. It will be appreciated that the ability to input a rider's weight and/or choosing a board design are optional features that may not be included in some embodiments.

In another embodiment, there may be many speeds that can be selected manually by the user, such as 10, 20, or more or less than 20 pre-set speeds. The user may be able to initially choose a first speed that they know is less than a hydrofoiling speed. For example, this may be a third or fourth level out of ten options. When they want to begin hydrofoiling, they can then increase the speed to a level they know is sufficient for hydrofoiling, such as a level eight or nine for example, by repeatedly pressing the appropriate button on the hand controller.

In an embodiment, the user may also select desired acceleration/power curves for the board. For example, a beginner rider may wish for gentle acceleration of the board, thus allowing them to focus on obtaining and maintaining their balance on the board. By this arrangement, the beginner may wish for the board to accelerate smoothly and slowly from a stationary position up to the first speed. The user may also wish for the board to accelerate smoothly and slowly from the first speed to a second speed. The user may also wish for the board to accelerate smoothly and slowly in reaction to the speed adjusting buttons being activated after the board has reached the second speed. In contrast, a more advance rider may wish for a more aggressive transition between speeds, for instance, in order to increase their sense of thrill in riding the board.

In an embodiment, acceleration curves may be selected and customized via the hand controller. In another embodiment, such acceleration curves may be selected using externally connected hardware, such as a laptop or mobile application.

In an embodiment, the speed of the board may be measured and controlled via a GPS. The GPS may be incorporated into the hand controller and/or into the board. The GPS may communicate with the propulsion source of the board such that the speed of the board is monitored and controlled by the GPS. By this arrangement, once an operating pre-set has been selected, the propulsion source will increase the speed of the board until the speed associated with that operating pre-set has been achieved, wherein the speed is measured by the GPS. The GPS may also communicate with the hand controller in order to display the speed of the board on the output device.

In an embodiment, the GPS may also communicate with the propulsion source of the board so as to be used to throttle the power or speed down for different locations where regulations require limited power or speed limits. The GPS may also be used to throttle the power when the battery charge is low, battery temperature is high or any other potential problems with the system are detected.

In various other embodiments, the operating pre-sets may control the power of the motor rather than the speed of the board. That is, in each of the embodiment described above, the system may control the power of the motor to be constant or limited, rather than adjusting the power in order to control the speed as described.

For example, in an embodiment the method may include a first operating pre-set where the motor is brought up to a power level below that for hydrofoiling and a second operating pre-set where the motor is brought up to a power level sufficient for the board to begin hydrofoiling. Once the second operating pre-set has been selected, thus increasing the motor power to a level sufficient to begin hydrofoiling, the power level of the motor may be controlled, preferably via the hand controller, according to user preference.

The method may optionally also include a "wave mode" that can be selected when hydrofoiling, whereby the power is smoothly lowered to a pre-determined low power setting for wave riding, and then resetting the power to its level from before entering the wave mode.

In an embodiment, the hand controller may be fitted with an inertial measurement unit (IMU). In a further embodiment, the board may be fitted with an IMU. The IMUs of the hand controller and the board may be used to elicit a response if normal operating parameters are not met. For example, the IMUs of the hand controller and the board may elicit a safety response, such as cutting power to the propulsion source of the board, should the IMUs detect that certain normal operating parameters are not met.

In an embodiment, if the IMUs detect that the board is at an angle on an axis that would indicate that the board is not riding on the water, power may be cut to the propulsion source. Further, if the motor data and average direction of travel between the hand controller and the board as measured by their respective IMUs are not in sync, it would be surmised that the rider has fallen off the board and power to the propulsion source may be cut.

In an embodiment, the hand controller and/or board may include a processor and memory for calculating and storing various data during riding. This data may then be presented to the user by an output on the hand controller. For example, the processor may dynamically calculate remaining distance and time left while riding, using battery data supplied by a battery management system and other relevant information.

The processor may also calculate live efficiency in watt hours per kilometre (Wh/km) to help users maximise their ride time and/or distance. Other information may also be calculated and displayed, including diagnostic information such as motor rpm, battery temperature and power consumption, board angle and GPS speed, thereby helping the user to monitor their ride.

The above data may also be logged in a memory for later viewing or to be transferred to a remote computer system such as through a phone application or other separate hardware and/or software. Similarly, such external systems may be used to update settings or profiles of the board.

Referring to FIG. 1, shown is a flowchart of an example method for operating a hydrofoil board. In a first step denoted as 1, a user may input the relevant design parameters such that the first and second speeds are determined. The user may also input their desired acceleration/power curves such that the responsiveness of the board is determined.

In a second step denoted as 2, the user may mount the board and select the first operating pre-set via the hand controller such that the board will accelerate up to the first speed according to the selected acceleration curve. In a third step denoted as 3, the user may alter their riding stance, for example, to a standing stance, and select the second operating pre-set via the hand controller such that the board will accelerate up to a second speed.

In a fourth step denoted as 4, the user may shift their weight backwardly such that the board will begin hydrofoiling and rise above the surface of the water. In a fifth step denoted as 5, the user may adjust the speed of the hydrofoiling board via the hand controller.

Figure 2:
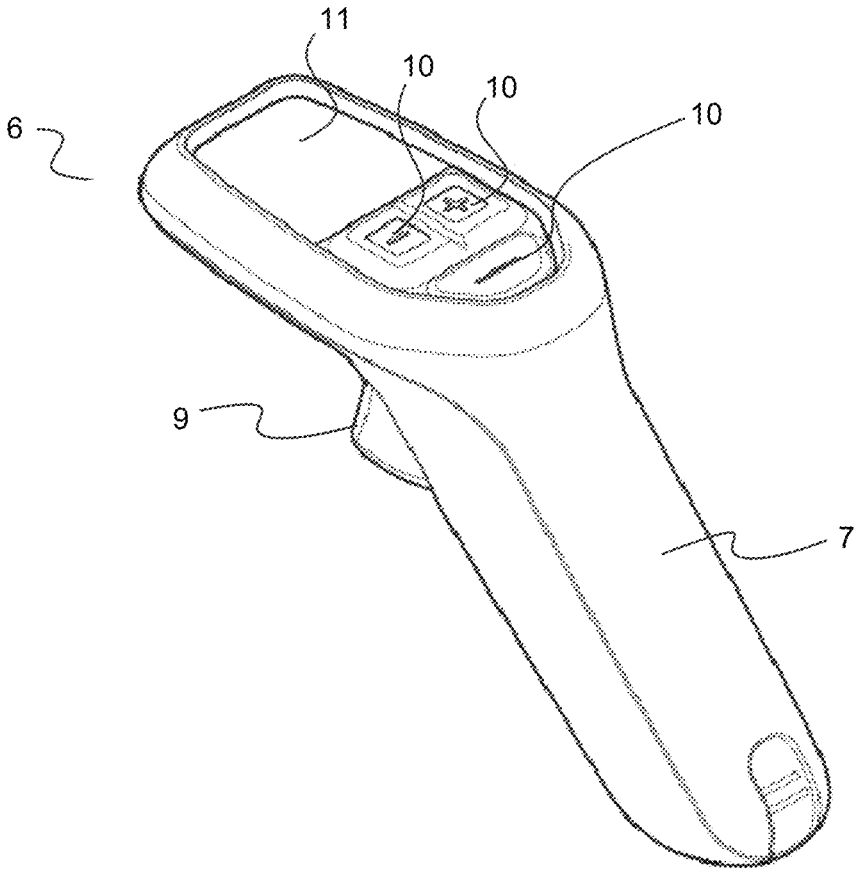
FIG. 2 illustrates a view of an embodiment of a hand controller for use with a method for operating a hydrofoil board.

Referring now to FIG. 2, shown is an embodiment of a hand controller 6 suitable for use with the method for operating the hydrofoil board. The hand controller 6 has a handle 7, allowing the hand controller 6 to be gripped by the user. The handle 7 may have a lanyard (not-shown) for placement about the wrist of the user so as to tether the hand controller 6 to the user's wrist should they lose grip of the handle 7.

The handle 7 is in the form of a pistol style grip having an actuator in the form of a trigger 9 accessible by the finger of the user having grip of the handle 7. The trigger 9 can act as an accelerator or throttle, whereby variable levels of power/speed can be indicated by partially pressing the trigger 9. The hand controller 6 also has actuators in the form of buttons 10 that can be pressed by the thumb of the user having grip of the handle 7.

The hand controller 6 has a display screen 11 at a top portion, which is proximate to the buttons 10, such that the user having grip of the handle 7 can conveniently glance at the screen 11. The screen 11 may display certain outputs, such as speed of the board, distance travelled, battery life remaining, riding time remaining and the like. These metrics may be accessible via a number of display screen layouts that can be scrolled to by the user using their thumb and a mode button 10, for example.

The hand controller 6 is small enough to allow single handed operation. That is, the trigger 9 can be operated by the user simultaneously to pressing one or more of the buttons 10 while having grip of the handle 7. In fact, the controller 6 is small enough that most riders will be able to use the palm of their hand to press on the board to stand up without the controller 6 hitting the board.

In the preferred embodiment shown, the hand controller 6 is water proof and uses a Hall Effect sensor for the throttle, thereby allowing the trigger 9 to be movable while maintaining the water proof nature of the main housing of the hand controller 6. It will be appreciated, however, that alternative forms of sensor could be used in alternative embodiments. Additionally, the controller 6 includes a moulded foam insert that ensures the controller 6 will float in water in the event that it is dropped.

The hand controller 6 preferably also includes a buzzer and/or vibrator. The buzzer and/or vibrator can be used to alert the rider to pop up warnings on the display screen 11 when riding. These warnings may indicate such states as: half board battery; low board battery; empty battery; low controller battery; high temperature; high current; and new maximum speed.

Figure 3:
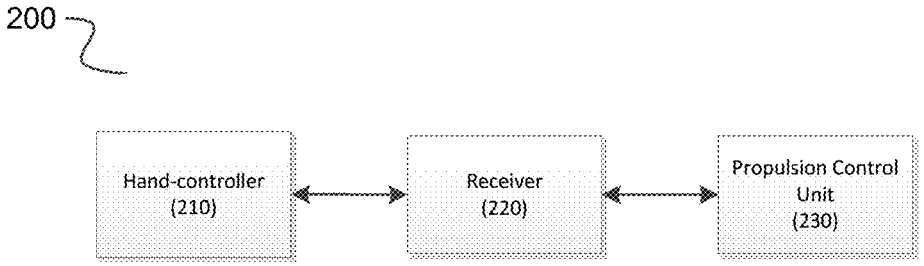
FIG. 3 illustrates a block diagram of an embodiment of a system for operating a hydrofoil board.

Referring to FIG. 3, there is illustrated an example system 200 for operating a hydrofoil board. In an embodiment, the system 200 may be used to perform the method as herein before described. As shown in the Figure, the system 200 includes a hand controller 210 that is in communication with a receiver 220, which in turn is in communication with a propulsion control unit 230. The hand controller 210 may be a portable, user-operated controller that may allow a user to communicate with the propulsion control unit 230 via the receiver 220, and to remotely operate and/or control the propulsion control unit 230.

In some examples, the hand controller 210 has a housing which includes a user interface for the input of commands by a user. The user interface may include one or more push-buttons, such as a "plus" button, a "minus" button, and a "mode/menu" button.

The housing may further include a display screen to display settings of the system 200 to the user. The display screen may include an organic light-emitting diode (OLED) display screen, or a passive-matrix OLED (PMOLED) display screen, or any other type of electronic display screen. In other examples, the housing may include a touch display which may provide a user interface and display information to the user. Preferably, though not necessarily, the housing of the hand controller 210 is waterproof.

The hand controller 210 may further include one or more motion sensors for sensing a motion and/or orientation of the hand controller 210. The one or more motion sensors may include an inertial measurement unit, accelerometer, a gyroscope, or any other motion sensor. In some examples, the motion sensor is a six-axis motion sensor including a three-axis gyroscope and a three-axis accelerometer.

The hand controller 210 may further include a communications unit for communicating with the receiver 220. Preferably, though not necessarily, the communications unit is a wireless communications unit, such as a Bluetooth module, configured to communicate wirelessly with the receiver 220. The hand controller 210 may further include an antenna to facilitate wireless communication between the wireless communications unit and the receiver 220.

Figure 4:
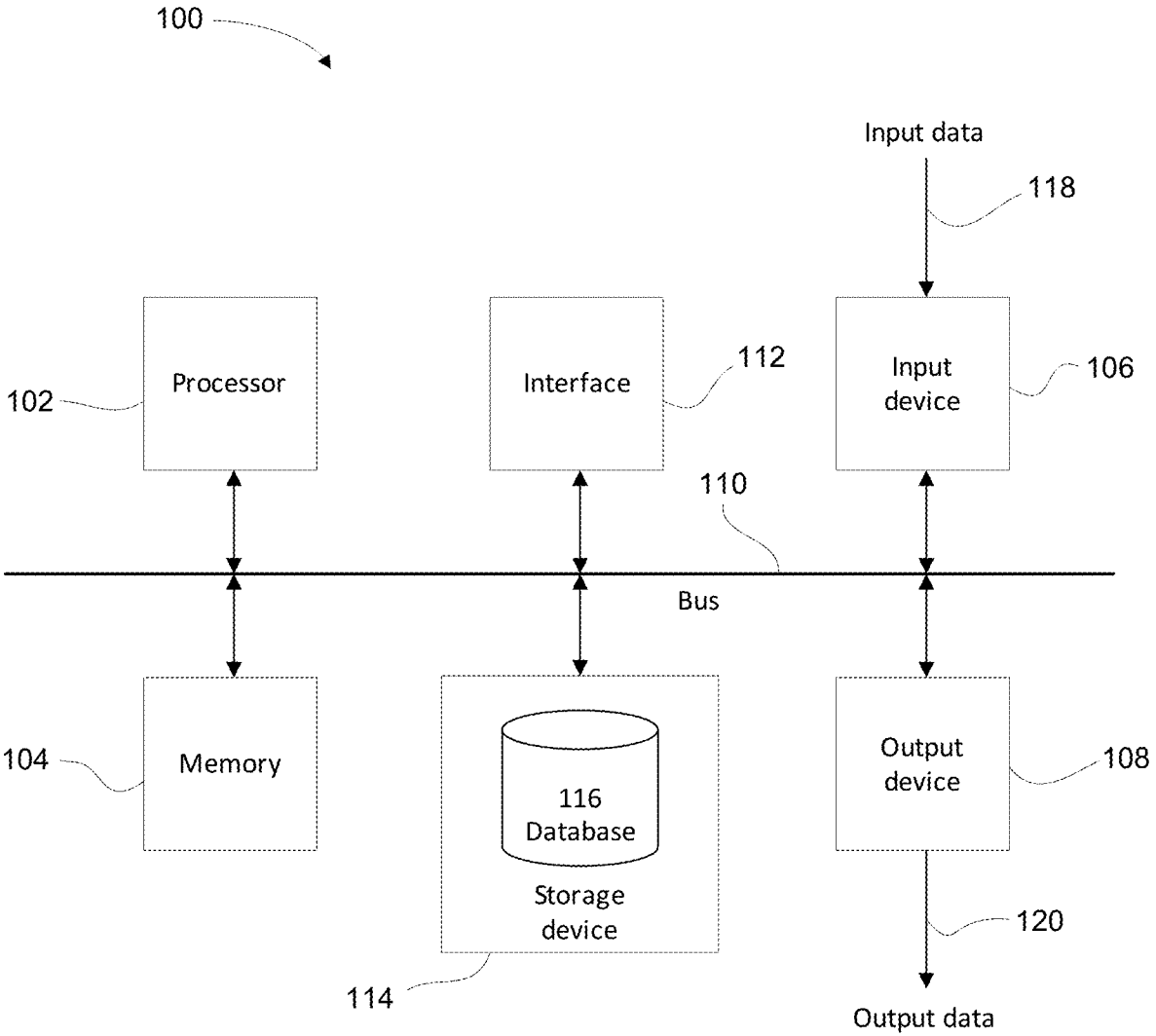
FIG. 4 illustrates an example processing system for use with a system for operating a hydrofoil board.

The processing system may also optionally facilitate a user inputting certain parameters to affect the performance of the board, such as user weight and acceleration/power curves as hereinbefore described. In an embodiment, the processing system may take the form of an example processing system 100 as illustrated in FIG. 4 and described in more detail below.

The hand controller 210 may further include a processing system configured to receive user input commands from the user interface, to receive motion and/or orientation data from the one or more motion sensors, to operate the display screen to display settings of the system 200, and to send data and/or command signals to the propulsion control unit 230 via the receiver 220.

Preferably, though not necessarily, the hand controller 210 is battery-powered. The hand controller 210 further includes a battery, such as a lithium-polymer battery. Preferably, though not necessarily, the battery is a rechargeable battery. The hand controller 210 further includes charging circuitry for charging the battery, such as a USB port and USB charging circuitry. The battery may be used to power at least the processing system and the display screen of hand controller 210. The hand controller 210 may further include one or more power converters to adjust or condition a battery output power for powering the processing system, the display screen, and any other device of the hand controller 210.

The hand controller 210 may further include an ignition circuit to turn on or off the processing system. The ignition circuit may include a magnetic sensor, such as a Hall Effect sensor, within the housing, and one or more magnets mounted to the exterior of the housing to activate and/or deactivate the hand controller 210.

In some examples, the receiver 220 may be configured to be embedded within the hydrofoil board. In other examples, the receiver 220 may be configured to be fixed, or attached, to the hydrofoil board. In some examples, the receiver 220 may be embedded within or fixed to a front or tip portion of the hydrofoil board, such as the "nose" of the hydrofoil board. The receiver 220 may include a housing. Preferably, though not necessarily, the housing is waterproof.

The receiver 220 may include a communications unit for communicating with the hand controller 210. Preferably, though not necessarily, the communications unit may be a wireless communications unit, such as a Bluetooth module, configured to communicate wirelessly with the hand controller 210. The receiver 220 may further include an antenna to facilitate wireless communication between the wireless communications unit and the hand controller 210.

The receiver 220 may further include an ignition circuit to turn on or off the processing system. The ignition circuit may include a magnetic sensor, such as a Hall Effect sensor, within the housing. The receiver 220 further includes light-emitting diodes (LEDs) for providing visual cues of a status of the receiver 220, such as whether the receiver 220 is active or inactive.

In one embodiment, a magnet is included in the butt of the hand controller 210 that is used to activate a magnetic sensor in the receiver 220 on the board. This can serve as a safety feature to arm the board motor. This same system can also be used to put the board in a pairing mode. Lights on the receiver 220 on the board may change colour and/or use a flashing pattern to signify the status of the hand controller connection and state of use. Similarly, the hand controller may provide a visual indication and/or vibration when the board is activated in this way and armed and ready for use.

The receiver 220 may further include a positioning system to locate the receiver 220 in a spatial frame of reference. Preferably, though not necessarily, the positioning system is a GPS receiver, or a GPS module connected to a GPS antenna, for receiving information from GPS satellites and calculating the geographical position of the receiver 220.

The receiver 220 may further include a processing system configured to receive user input commands from the user interface, to receive position data from the positioning system, and to calculate a velocity of the receiver 220 from the position data. The processing system is further configured to operate the LEDs. The processing system may take the form of the example processing system 100.

The receiver 220 may further include a connector to enable a wired connection to the propulsion control unit 230. In some examples, the processing system may be further configured to send data to the propulsion control unit 230 through the connector. In some examples, the propulsion control unit 230 is configured to supply a power signal to the receiver 220 through the connector.

The receiver 220 may further include one or more power converters to adjust or condition the power signal from the connector for powering the processing system and any other device of the receiver 220.

The receiver 220 including the integrated components such as the magnetic ignition switch, GPS and GPS antennae and the Bluetooth antennae may be located in the nose/forward portion of the board. The nose portion of the board may be more likely to remain above the water surface when a user positions themselves on the board.

This arrangement may provide for more optimal transmission between the receiver 220 and the hand controller 210 as well as for better GPS reception. Even in a stationary position, a user lying on the board in a prone position generally orientates themselves toward the back of the board, which may cause the front of the board to raise above the water surface, such that placement of the receiver 220 in the nose of the board may provide a more reliable control link when first providing power to the propulsion source.

While other systems may check signal strength and turn off the controller connection if the signal is not strong enough, this is typically not required in the present system because a digital signal is used with error checking built in.

The propulsion control unit 230 may be configured to be housed within the hydrofoil board and to be coupled to a propulsion source. For example, the propulsion control unit may be drivingly coupled to a propeller of the hydrofoil board. Preferably, though not necessarily, the propulsion control unit 230 is mounted to a tail portion of the hydrofoil board, where the propeller is located.

The propulsion control unit 230 may include a motor controller operatively connected to a motor for driving the propeller. The motor may be a three-phase brushless DC motor.

The propulsion control unit 230 may further include a processing system configured to receive a first user input from the hand controller 210, selecting one of a plurality of operating pre-sets of operation of the propulsion control unit 230. The processing system may be further configured to operate the motor through the motor controller according to the selected operating pre-set.

The operating pre-sets may be selected by the user via the user interface of the hand controller 210. The operating pre-sets may correspond to different styles of operation of the board. For example, one such operating pre-set may correspond to the method of operating the board as hereinbefore described.

The propulsion control unit 230 may further include a battery module, including a battery and a battery management system, for powering the processing system, the motor controller, and any other device of the propulsion control unit 230. The propulsion control unit 230 may further include one or more power converters to adjust or condition a power signal from the battery module.

The propulsion control unit 230 is connected to the receiver 220 through a wire, or cable, connected to the connector of the receiver 220. The battery module of the propulsion control unit 230 may further be configured to supply power to the receiver 220 through the wire or cable.

In an embodiment, the propulsion control unit 230 and/or the receiver 220 may communicate with the hand controller 210, for instance, to display information drawn from the system 200 on the screen of the hand controller. By way of example, the battery management system of the propulsion control unit 230 may communicate to provide such output on the screen of the hand controller 210 as battery life remaining and dynamic range information. Similarly, the GPS integrated with the receiver 220 may communicate to provide such output on the screen of the hand controller 210 as the speed of the board and the distance travelled.

In an embodiment, a first user selected operating mode of operation may correspond to the method for operating the board as hereinbefore described. If the user wanted to use the board according to this operating mode, they may select the operating mode using the user interface of the hand controller. The user may also optionally be able to select their weight and configure the acceleration/power curves by which they wish the propulsion source to perform and select parameters relating to the type of the board used. A processing system of the system 200 may then use these user inputs to determine the first and second speed of the first operating pre-set. The rider could then ride the board according to the first operating mode.

In an embodiment, there may be provided other operating modes. For example, there may be a second operating mode without operating pre-sets, wherein the power delivered to the propulsion system is purely responsive to the trigger of the hand controller. Otherwise stated, the trigger may act as a throttle adjusting power to the propulsion source. However, in this operating mode, the acceleration/power curves mapping the action of the trigger to the power of the propulsion source via the system 200 may be user configurable. The user may select a certain acceleration curve depending on their preference, for example an advanced user may select an aggressive curve to increase the propulsion sources response to the trigger so as to increase the thrill of the riding experience.

By way of example, there may be a third operating mode wherein the speed of the board may be increased or decreased in an incremental/step-wise fashion instead of continuously via the trigger acting as a throttle as per the second operating mode.

Such an operating mode may be analogous to a geared arrangement, wherein the user can actuate a button on the hand controller so as to communicate with the propulsion source and GPS to increase the speed of the board by a certain amount. The user may then actuate the button again to further increase the speed of the board by a certain amount and so on. Similarly, the user may actuate a button to decrease the board by a certain amount.

Conveniently, the hand controller may include buttons marked with a "–" and a "+" indicia for decreasing and increasing the speed of the board incrementally as described. The system may include 10 speeds or gears, 20 speeds or gears, or more or less speeds or gears as may be convenient or desirable for operation of the board.

In one example, a wave mode may be activated by pressing and/or holding the "–" button to smoothly shift power back to a pre-determined low power setting for wave riding, and then tapping the "+" button to reset the power to its level from before entering the wave mode.

By way of further example, there may be a fourth operating mode wherein the maximum speed of the board may be increased or decreased in an incremental/step-wise fashion as well as continuously up to this maximum via the trigger acting as a throttle as per the second operating mode.

Such an operating mode may be analogous to a geared arrangement, wherein the user can actuate a button on the hand controller so as to communicate with the propulsion source and GPS to increase the speed of the board by a certain amount. The user may then actuate the button again to further increase the speed of the board by a certain amount and so on. Similarly, the user may actuate a button to decrease the board by a certain amount.

In an embodiment, the system may be configurable such that the amount and rate of speed increase and decrease experienced by the board in response to actuation of the relevant button can be varied. The system 200 may use the GPS in order to measure the speed such that the propulsion control unit may control the propulsion source to achieve the correct speed, as is the case with the other operating modes.

A particular embodiment of the present invention can be realised using one or more processing systems, an example of which is shown in FIG. 4. In particular, the processing system 100 generally includes at least one processor 102, or processing unit or plurality of processors, memory 104, at least one input device 106 and at least one output device 108, all coupled together via a bus or group of buses 110. In certain embodiments, the input device 106 and the output device 108 could be the same device.

An interface 112 can also be provided for coupling the processing system 100 to one or more peripheral devices. For example, the interface 112 could be a PCI card or PC card. At least one storage device 114 which houses at least one database 116 can also be provided. The memory 104 can be any form of memory device, for example, volatile or non-volatile memory, solid state storage devices, magnetic devices, etc. The processor 102 could include more than one distinct processing device, for example to handle different functions within the processing system 100.

The input device 106 receives input data 118 and can include, for example, a keyboard, a pointer device such as a pen-like device or a mouse, audio receiving device for voice controlled activation such as a microphone, data receiver or antenna such as a modem or wireless data adaptor, data acquisition card, etc. The input data 118 could come from different sources, for example keyboard instructions in conjunction with data received via a network.

The output device 108 produces or generates output data 120 and can include, for example, a display device or monitor in which case the output data 120 is visual, a printer in which case the output data 120 is printed, a port for example a USB port, a peripheral component adaptor, a data transmitter or antenna such as a modem or wireless network adaptor, etc.

The output data 120 could be distinct and derived from different output devices, for example a visual display on a monitor in conjunction with data transmitted to a network. The user could view the data output, or an interpretation of the data output, on, for example, a monitor or using a printer. The storage device 114 can be any form of data or information storage means, for example, volatile or non-volatile memory, solid state storage devices, magnetic devices, etc.

In use, the processing system 100 is adapted to allow data or information to be stored in and/or retrieved from, via wired or wireless communication means, the at least one database 116. The interface 112 may allow wired and/or wireless communication between the processing unit 102 and peripheral components that may serve a specialised purpose.

The processor 102 receives instructions as input data 118 via the input device 106 and can display processed results or other output to a user by utilising the output device 108. More than one input device 106 and/or output device 108 can be provided. It should be appreciated that the processing system 100 may be any form of terminal, server, specialised hardware, or the like.

Figure 5:
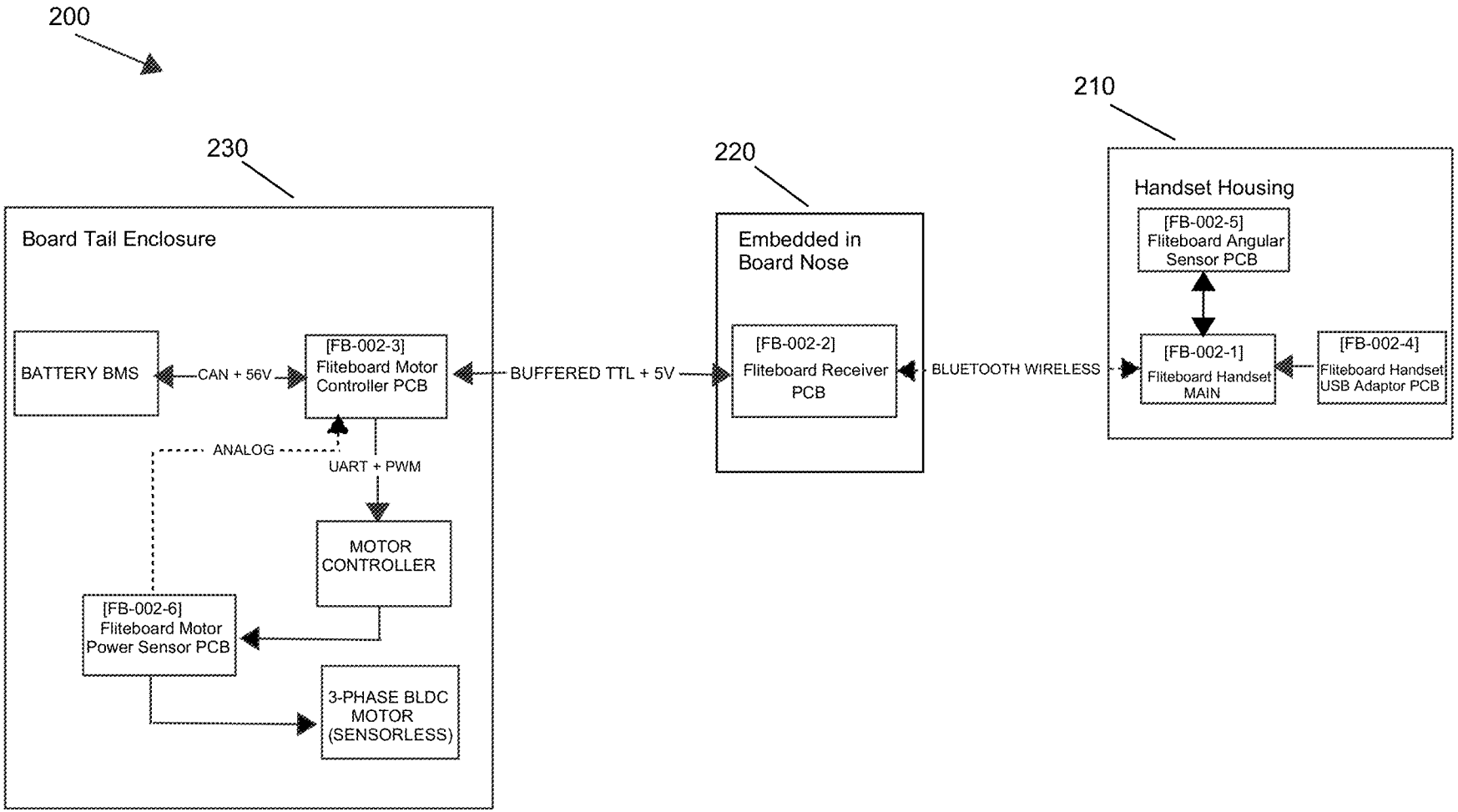
FIG. 5 illustrates a block diagram of an embodiment of a system for operating a hydrofoil board.

Referring to FIG. 5, shown is a block diagram of an embodiment of the system 200 providing some additional details of the hand controller 210, the receiver 220 and the propulsion control unit 230.

Figure 6:
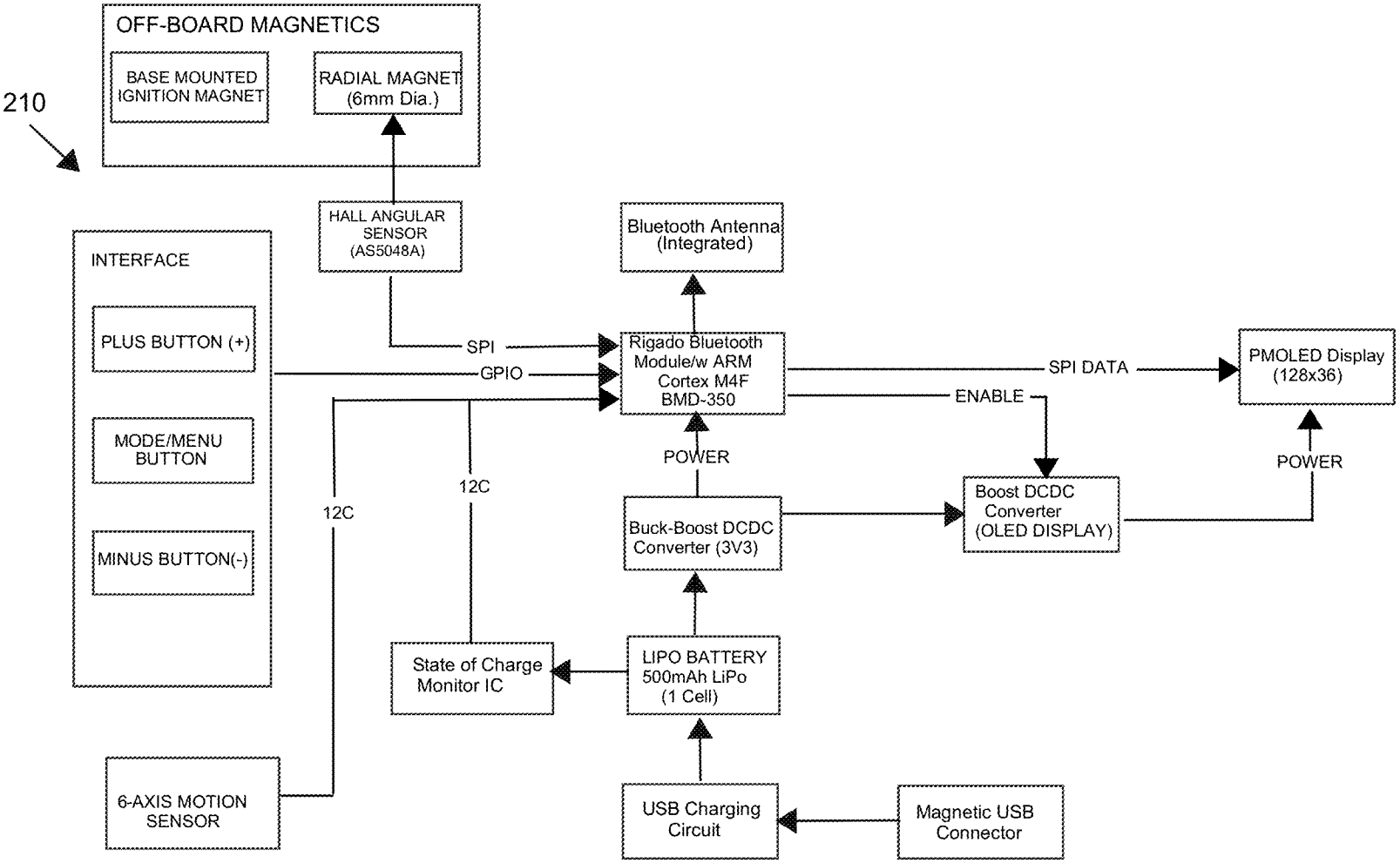
FIG. 6 illustrates a block diagram of an embodiment of a hand controller for use with a system for operating a hydrofoil board.
Figure 7:
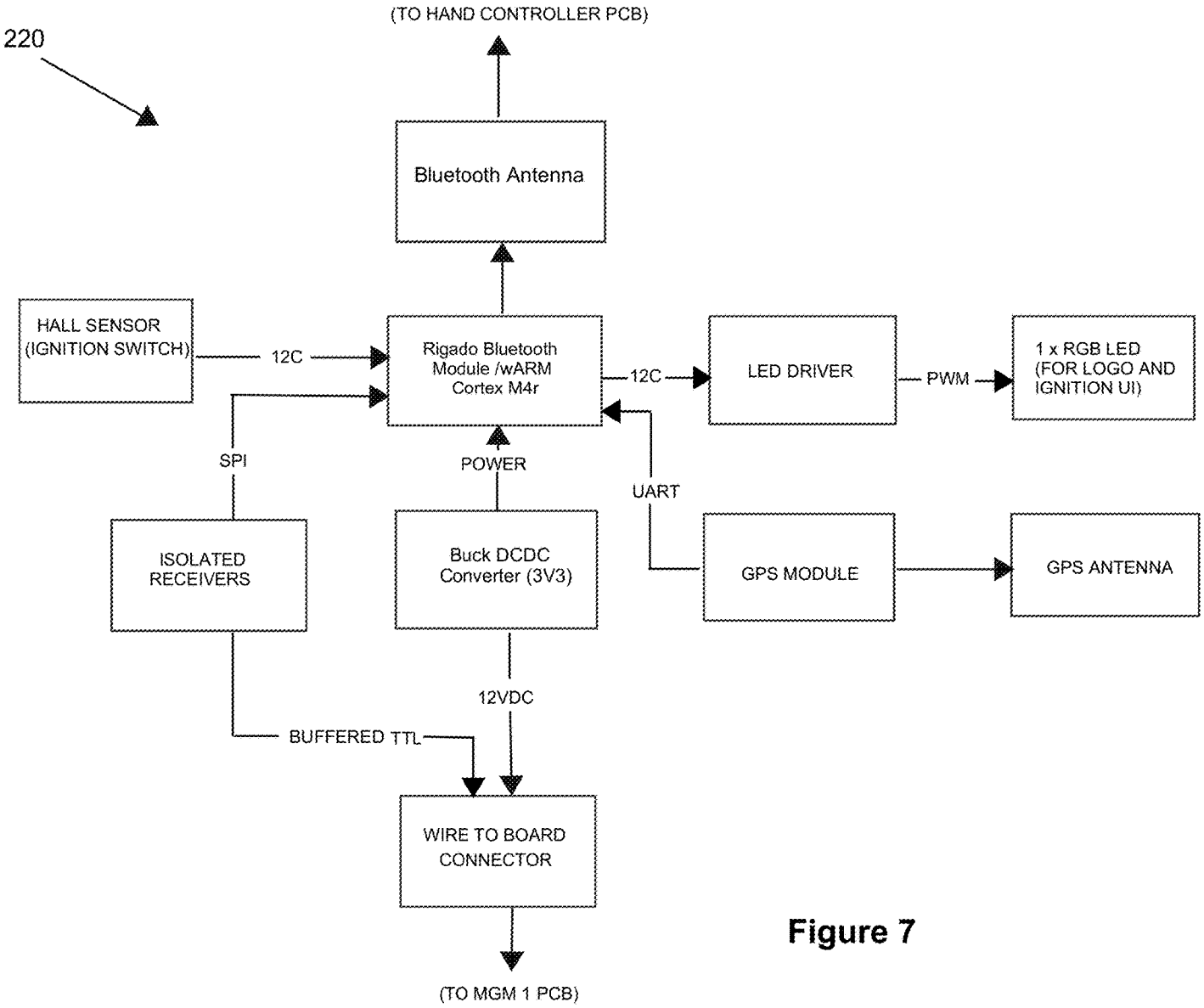
FIG. 7 illustrates a block diagram of an embodiment of a receiver for use with a system for operating a hydrofoil board.
Figure 8:
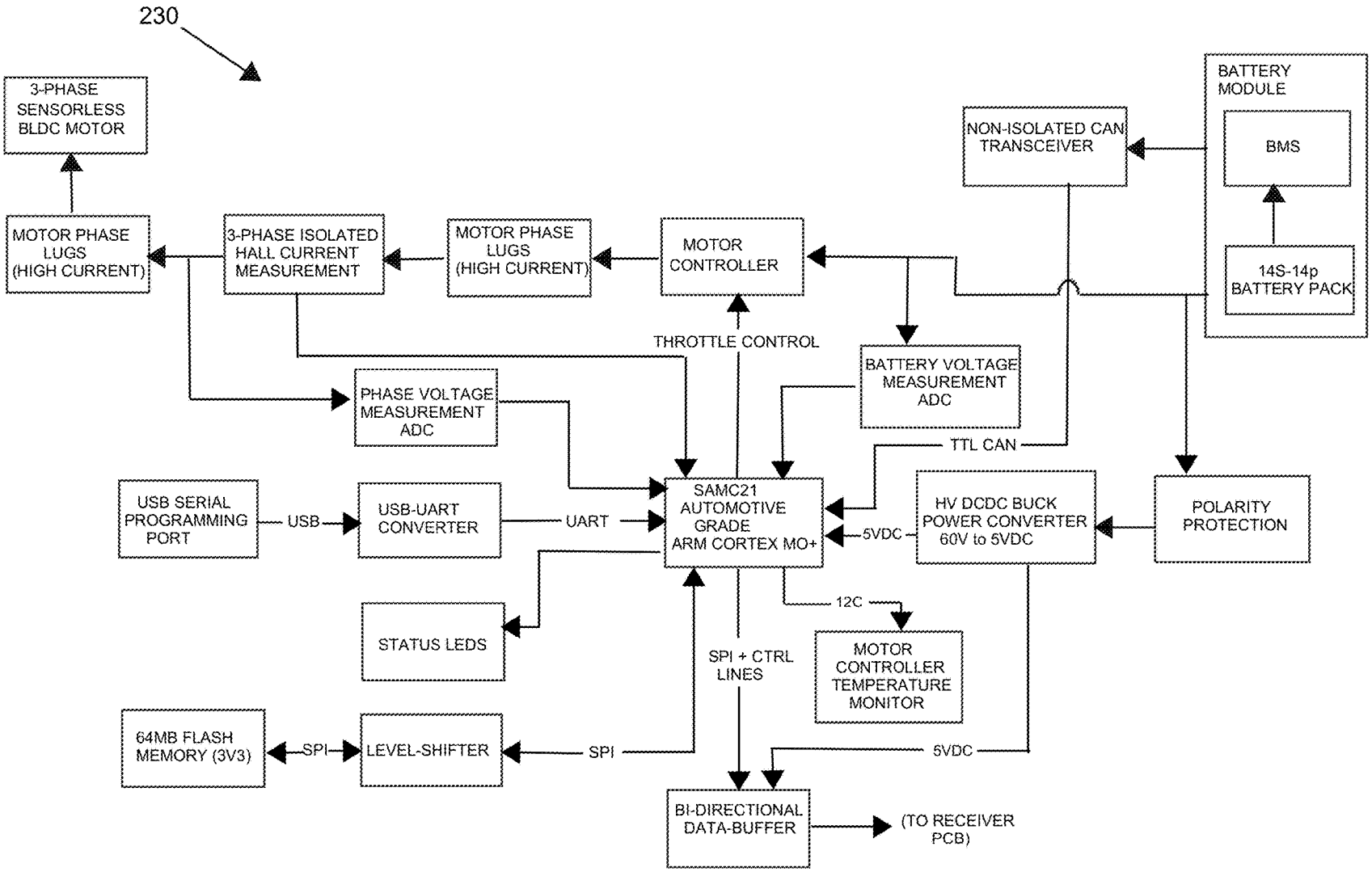
FIG. 8 illustrates a block diagram of an embodiment of a propulsion control unit for use with a system for operating a hydrofoil board.

Referring to FIG. 6, shown is a block diagram of an embodiment of the hand controller 210 providing some additional details. Referring to FIG. 7, shown is a block diagram of an embodiment of the receiver 220 providing some additional details. Referring to FIG. 8, shown is a block diagram of an embodiment of the propulsion control unit 230.

Whilst the present invention has been described with reference to particular embodiments, it will be understood that many modifications will be apparent to those skilled in the art. All such variations and modifications should be considered to fall within the scope of the invention as broadly described and as claimed below.

In the foregoing description of preferred embodiments, specific terminology has been resorted to for the sake of clarity. However, the invention is not intended to be limited to the specific terms so selected, and it is to be understood that each specific term includes all technical equivalents which operate in a similar manner to accomplish a similar technical purpose. Terms such as "front" and "rear", "inner" and "outer", "above" and "below" and the like are used as words of convenience to provide reference points and are not to be construed as limiting terms.

Throughout this specification and the claims which follow, unless the context requires otherwise, the word "comprise", and variations such as "comprises" or "comprising", will be understood to imply the inclusion of a stated integer or step or group of integers or steps but not the exclusion of any other integer or step or group of integers or steps.

The invention claimed is:

1. A method of controlling a hydrofoil board powered by a motor driven propeller, wherein the motor is controlled by a hand controller configured with a throttle for regulating a speed of the board, the hand controller also configured with user selectable operating modes comprising:

a wave mode, wherein the board is operated in a low power setting that is suitable for wave riding; and an operational mode, wherein the board is operated according to user input from the throttle.

2. The method according to claim 1, wherein the power is regulated automatically when in the wave mode to match a speed of the board.

3. The method according to claim 1, further comprising a locked mode, wherein the board will not operate the motor even when the user activates the throttle.

4. The method according to claim 1, wherein the wave mode is activated by pressing and holding a first button for a pre-determined time.

5. The method according to claim 4, wherein pressing a second button activates the operational mode.

6. The method according to claim 1, wherein changing operating modes causes a smooth ramp in the power level.

7. The method according to claim 1, wherein the operational mode comprises a plurality of user selectable operating pre-sets comprising:

a first operating pre-set, wherein the board is limited to a maximum first speed which is less than that required for the board to hydrofoil; and a second operating pre-set, wherein the board is permitted to reach a second speed which is sufficient for the board to hydrofoil.

8. The method according to claim 7, wherein the throttle can be operated at the same time as a user switches between the operating pre-sets.

9. The method according to claim 1, wherein when in the wave mode the board continues to operate in the low power setting even if the throttle is completely released.

10. The method according to claim 1, wherein when in the wave mode the board continues to operate in the low power setting regardless of throttle position unless the throttle is completely released.

11. A system for operating a hydrofoil board, the system comprising:

a propulsion control unit comprising a propulsion source; and a hand controller configured to receive a first user input and a second user input and to transmit the user inputs to the propulsion control unit, the first user input being a variable throttle value and the second user input selecting one of a plurality of operating modes of operation of the propulsion control unit;

wherein in response to the second user input an operational mode or a wave mode can be selected; and wherein in response to the first user input the propulsion control unit is configured to:

a) drive the propulsion source according to the throttle value while in the operational mode; and b) drive the propulsion source in a low power setting that is suitable for wave riding when in the wave mode.

12. The system according to claim 11, further comprising a locked mode, wherein the propulsion control unit will not operate the propulsion source in response to the first user input.

13. The system according to claim 11, wherein the propulsion control unit regulates the propulsion source automatically when in the wave mode to match a speed of the board.

14. The system according to claim 11, wherein the wave mode is activated by pressing and holding a first button of the second user input for a pre-determined time.

15. The system according to claim 14, wherein pressing a second button of the second user input activates the operational mode.

16. The system according to claim 11, wherein changing operating modes causes the propulsion control unit to drive the propulsion source according to a smooth ramp between power levels.

17. The system according to claim 11, wherein the operational mode comprises a plurality of user selectable operating pre-sets comprising:

a first operating pre-set, wherein the propulsion source is limited to a maximum first level which is less than that required for the board to hydrofoil; and a second operating pre-set, wherein the propulsion source is permitted to reach a second level which is sufficient for the board to hydrofoil.

18. The system according to claim 17, wherein the first user input can be operated at the same time as a user switches between the operating pre-sets via the second user input.

19. The system according to claim 11, wherein when in the wave mode the propulsion source continues to operate in the low power setting even if the first user input is completely released.

20. The system according to claim 11, wherein when in the wave mode the propulsion source continues to operate in the low power setting regardless of throttle value of the first user input unless it is completely released.

* * * * *